United States Patent [19]

Mahnken

[11] 3,977,127

[45] Aug. 31, 1976

[54] MULTI-PURPOSE HOBBY FINISHING APPARATUS

[76] Inventor: L. Wesley Mahnken, 1102 E. Eldarado, Decatur, Ill. 62521

[22] Filed: June 25, 1975

[21] Appl. No.: 590,201

[52] U.S. Cl. ..... 51/5 R; 51/5 A; 51/5 B; 144/1 R; 408/25

[51] Int. Cl.[2] ..... B24B 27/00

[58] Field of Search ..... 51/3, 4, 5 R, 5 B, 5 E; 144/1 R, 1 B, 1 C; 408/25, 26

[56] References Cited

UNITED STATES PATENTS

| | | | |
|---|---|---|---|
| 510,438 | 12/1893 | Nelson | 51/4 |
| 1,670,731 | 5/1928 | Miller | 144/1 R X |
| 2,743,746 | 5/1956 | Davison | 144/1 R |
| 2,859,627 | 11/1958 | Gallop | 51/5 R X |
| 3,027,688 | 4/1962 | Zabransky | 51/5 R |
| 3,128,805 | 4/1964 | Silver | 144/1 C |

*Primary Examiner*—Al Lawrence Smith
*Assistant Examiner*—Gary L. Smith
*Attorney, Agent, or Firm*—Robert M. Ward

[57] ABSTRACT

The present invention generally concerns hobby finishing tools. More specifically, the present invention is directed to a multi-purpose hobby finishing apparatus for cutting, drilling, grinding and finishing hobby materials, such as especially glass, and also plastics, ceramics, and wood, which materials may be used in making useful and decorative lamps, candleholders, tumblers, vases, ashtrays and the like.

6 Claims, 4 Drawing Figures

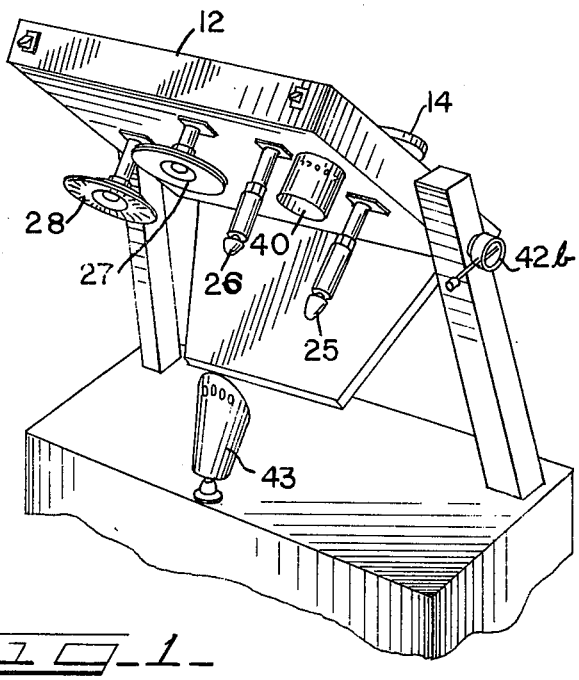
FIG. 1
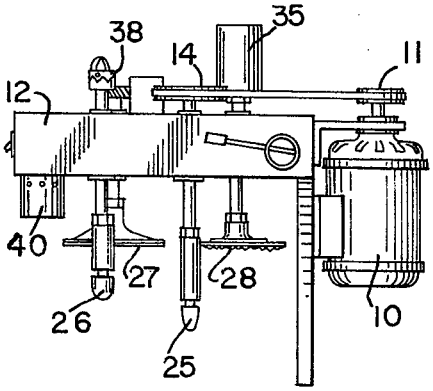
FIG. 3
FIG. 2
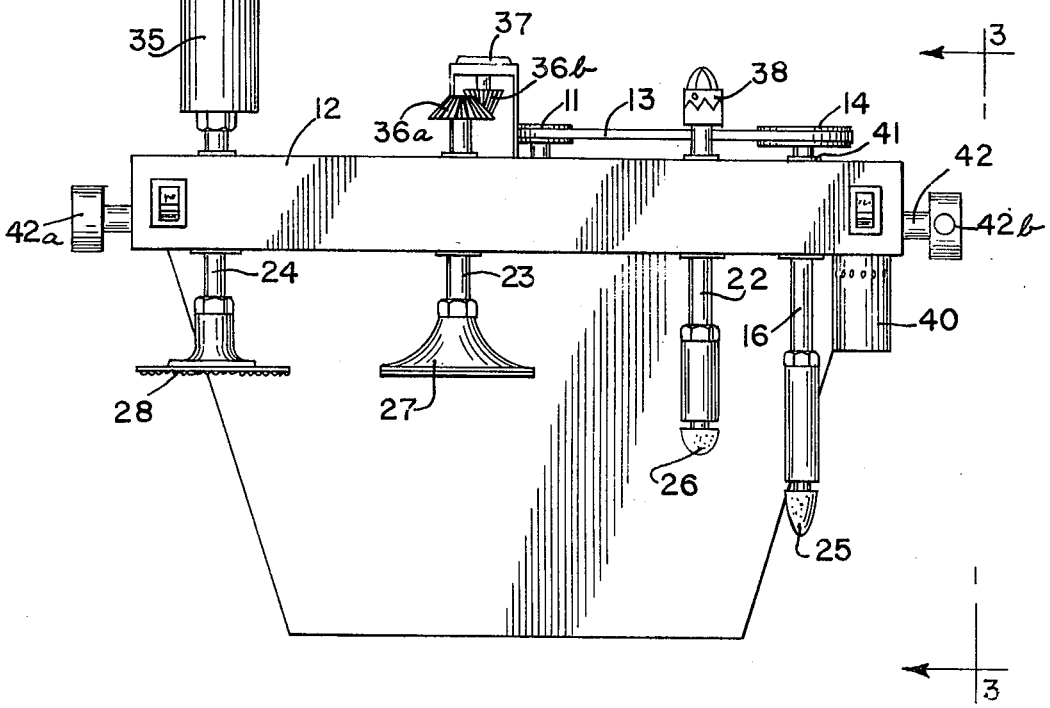

MULTI-PURPOSE HOBBY FINISHING APPARATUS

BACKGROUND OF THE INVENTION

Heretofore, when the hobby maker has desired to manufacture craft goods from such items as discarded glass containers and the like, the labor involved had to be done almost entirely by hand. An electric drill proved totally unsatisfactory because the speed was too great and could not be controlled to a speed within a critical R.P.M. range. Even if an electric drill could have been used as supplementarily to the hand operations, it would still be necessary to change the grinding implements thereon at frequent intervals, due to the various different multiple steps required in cutting, grinding, polishing, and finishing raw materials into a finished product and the various different tools required for each such step. Moreover, an electric drill would chip the glass, which is dangerous and which would produce totally unacceptable work.

A further difficulty with prior art techniques has been occasioned by the brittle and dangerous nature of glass itself. When working with any such brittle material, control of R.P.M.'s of the grinding tool within a narrow range is critical. The general inability precisely to control the R.P.M.'s on an electric drill has caused the hobby maker frequently to ruin many such discarded glass containers before obtaining a product suitable for use in the finished item. This complicating factor arose not only from the general inability to adjust the R.P.M.'s of the crude devices, such as the electric drills used, but also from the lack of suitable means for holding the drill in a completely stationary position.

A further difficulty associated with prior art techniques and apparatus for hobby finishing items, such as throw-away bottles, jars, jugs and other glass containers and objects, such as telephone wire insulators, has been the lack of a single tool which could be used for all of the steps necessary for working the raw material into the finished hobby item, including the necessary cutting, drilling, grinding, polishing and boring, buffing, and finishing.

A yet further difficulty with prior art glass working techniques was the necessity of spraying water on the edge being worked to avoid splintering. This was messy and required expensive and hard to operate equipment.

An additional problem with prior art techniques was the general inability to accommodate such techniques to working with glasses of differing wall thickness, different hardnesses and the prevailing lack of understanding of the use of sandpapers in conjunction with a power driven tool.

Accordingly, in view of the serious shortcomings of the prior art devices for hobby finishing, it is an object of the present invention to provide an apparatus which will, materially alleviate such difficulties.

It is an additional object of the present invention to provide in one machine all of the tools necessary for performing the steps of cutting, grinding, boring, buffing, polishing and finishing the materials used in which machine the R.P.M.'s of each necessary tool are adjustably maintained at proper levels for each such operation.

It is also an object of the present invention to provide a multiplicity of different polishing, grinding and sanding tools on shafts which are simultaneously pulleyed to turn at the R.P.M. necessary to the accomplishment of their individual purpose and in proper proportional relationship to one another.

Yet an additional object of the present invention is to provide a multi-purpose tool having a speed control thereon such that the R.P.M.'s necessary for the accomplishment of any individual task may be set precisely to avoid damage to the product being finished and subsequent waste of material.

A yet further object of the present invention is to provide a hobby finishing tool which may be used as a dry processing tool without the necessity of water being sprayed upon the object being crafted, which avoids messiness and the additional cost associated with providing such water to the grinding area.

A still further object of the present invention is to provide workable means for recycling glass containers and objects which otherwise would be without substantial utility and often have been discarded as valueless litter, and as such constitute an ecological threat.

SUMMARY OF THE INVENTION

The present invention drastically curtails the difficulties, frustrations and hazzards associated with prior art craft finishing techniques and apparatus in the glass hobbycraft area. The multi-purpose craft finishing apparatus of the present invention provides in one motor driven unit a multiplicity of sanders, including a brass drum preliminary sander, a finishing brass drum sander, a rubber disc sander and an aluminum disc sander, each disposed on its own individual shaft.

The individual shafts are driven by a common belt at R.P.M.'s in fixed relation to each other. One such shaft is provided with a tachometer. A rheostat electrically connected to the motor or integral with such motor unit may be used to set the shaft driving the tachometer at a precise R.P.M. output, which of necessity correspondingly and proportionately sets the remaining shafts at specific proportional R.P.M. outputs, as determined by the diameters of the pulleys on each shaft, upon which the common connecting belt is engaged.

The four primary sanding tools set forth hereinabove provide in one place and under controlled R.P.M. conditions all the tools necessary for finishing a discarded glass container into a finished product ready to be made into a lamp, tumbler, ashtray, candleholder, etc. The marked prior art difficulty of chipping of the edge surfaces is materially reduced, resulting in a savings of time, effort, frustration and raw materials. The R.P.M. levels may be set at maximum working speeds without exceeding a speed which would damage the product to be finished, thus resulting in a great saving of time, effort, human frustration and raw material to the hobbycrafter.

Multi-purpose craft finishing apparatus in accordance with the present invention may also preferably have a drill chuck for accommodating various tools, such as flexible shafts, buffers, stones, wire wheels, sander discs, and the like, to provide means for any operation that may be required in the hobby finishing operation. Additionally, a tumbler means in the form of a circular drum may be provided which is used to mix, tumble and break any materials desired, as well as to accomplish certain polishing operations on small objects, such as rocks or stones which may be useful inlays and so forth. Alternatively, a power driven hacksaw with a tungsten-carbide blade may be provided for supplementary cutting operations, such as the removal of bottle necks.

Additionally, in the present invention, each of the tools is held firmly, but with reduced friction, by bearings in a fixed spatial relationship, such that the craftsman may work quickly and professionally without having to change the grinding surfaces, as was formally required in the prior art when only one operating shaft was being utilized, as on a power drill. Also the inherent steadiness of the shaft supporting frame of the present invention eliminates virtually all chipping and gouging due to shaft wobble, as was formally experienced in the art.

Various other modifications of the present invention are intended to be embodied and will become apparent to those skilled in the art from the teaching of the principles of the invention in connection with the disclosure of the specification, the claims and the drawing.

BRIEF DESCRIPTION OF THE DRAWING

FIG. 1 is a perspective view of the multi-purpose craft finishing apparatus of the present invention adjustably mounted upon a support structure with the frame thereof pivoted to place the various sanders in convenient disposition for their utilization by a hobby crafter;

FIG. 2 is a front elevational view of the multi-purpose craft finishing apparatus of the present invention showing the relative disposition of the various sanders and other tools, speed regulating means, and illumination means;

FIG. 3 is a view taken along line 3—3 of FIG. 2, also showing such motor means.

DETAILED DESCRIPTION OF PREFERRED EMBODIMENTS

Figure 4:
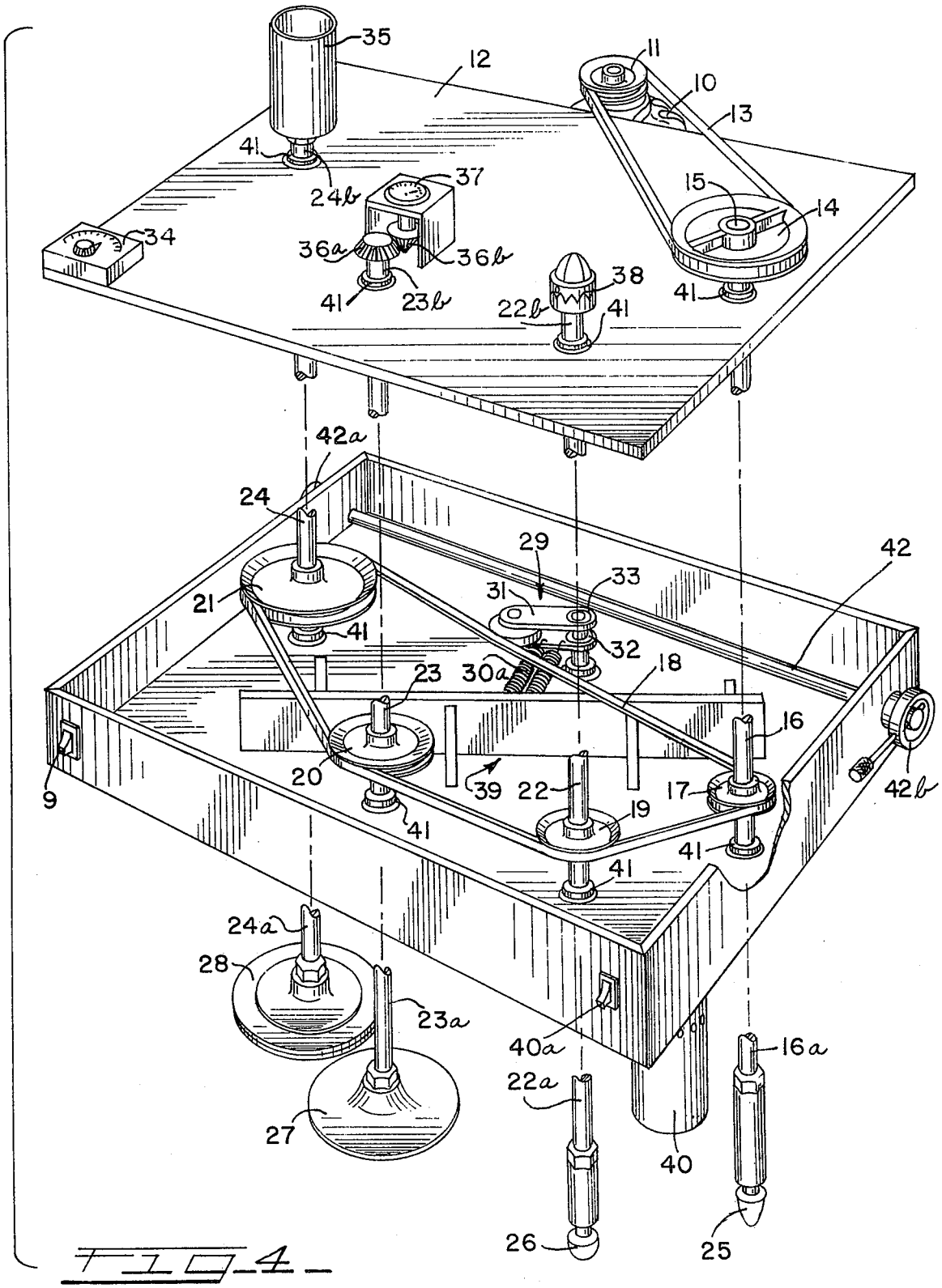
FIG. 4 is an exploded top perspective view of the multi-purpose craft finishing apparatus of the present invention with the frame pivoted to place the tumbler, drill chuck and speed control mechanism in operational disposition, showing also the various shafts, pulleys and sanders, as well as such speed control mechanism and other tools.

A multi-purpose craft finishing apparatus in accordance with the present invention comprises a plurality of shafts, one of which is driven by a motor belt which is driven in turn by an electric motor. Such motor has a speed control electrically connected thereto in the form of a rheostat, which permits adjustment of the R.P.M. of such motor. Such adjustments are monitored on a tachometer which is driven by one such output shaft.

One output shaft has a brass drum preliminary sander attached to its distal end, which preferably is driven at no more than approximately 516 R.P.M. A second output shaft has a finishing brass drum sander attached to ist distal end, which sander is preferably driven at no more than approximately 395 R.P.M. A third such output shaft has on the distal end thereof a rubber disc sander, which preferably is driven at approximately 330 to 340 R.P.M. A fourth output shaft has attached to its distal end an aluminum disc sander, which is driven at approximately 200 to 300 R.P.M.

A connecting belt is provided for simultaneously driving the output shafts with one such output shaft being driven by the motor belt. The other output shafts are then driven from the first shaft by means of a connecting belt.

A spring loaded idler means is preferably provided for maintaining the connecting belt in a tight drivable engagement with each shaft pulley. A frame is further provided for holding the various shafts in fixed spatial relationship with one another to provide stability to the system during hobby crafting operations. A circular tumbling drum may also be attached to the proximal end of one of the shafts for mixing, breaking or polishing operations. Alternatively, such shaft may be used to accommodate a power driven hacksaw for any supplementary cutting, such as removing small diameter bottle tops, that may be necessary. A drill chuck additionally may be attached to the proximal end of yet another shaft for accommodating any other tools that may be desirable or necessary. Preferably, illumination means are provided for shedding light upon the various distal ends bearing the different types of sanders, such that during working operations close visual monitoring may be made of the object being processed.

Referring now to the drawing and most particularly to FIG. 4, which shows the internal features in some detail, an electrical motor operable by a motor switch 9 and driving a motor pulley 11 is attached to a frame structure 12. Such motor pulley 11 drives a motor belt 13 which in turn drives a motor driven pulley 14. The motor belt driven pulley 14 is attached to the proximal end 15 of a first shaft 16 which is also held firmly by the frame 12. Disposed on first shaft 16 is a first shaft pulley 17 which drivably engages a connecting belt 18. Such connecting belt 18 drivably engages second, third and fourth shaft pulleys 19, 20, 21 associated respectively with second, third and fourth shafts 22, 23, 24. The distal ends 16*a*, 22*a*, 23*a*, 24*a* of each such shaft are provided respectively with a brass drum preliminary sander 25, a finishing brass sander 26, a rubber disc sander 27 and an aluminum disc sander 28 for accomplishing the various grinding and finishing steps as set forth hereinbelow.

The connecting belt 18 is held firmly against such shafts pulleys 17, 19, 20, 21 for drivable engagement thereof by means of a spring loaded idler mechanism designated generally at 29. The idler mechanism 29 comprises double idler springs 30*a*, 30*b* for urging idler mechanism 29 into firm engagement with connecting belt 18. A swivelable idler bearing arm 31 has an idler bearing collar 32 disposed on the distal end thereof; such idler bearing collar 32 is preferably provided with bearings 33 to provide for longevity of use.

A speed control mechanism 34 preferably in the form of a rheostat is electrically connected to motor 10 for adjusting the R.P.M. output of such motor, although such rheostat may be integral with the motor means. A circular tumbler drum 35 may preferably be attached to the proximal end 24*b* of one of the output shafts, for example output shaft 24. Alternatively, output shaft 24 may be used to drive a hacksaw assembly with a tungsten-carbide blade for cutting operations (not shown). Another of the output shafts, for example output shaft 23 may have disposed by means of gearing 36*a*, 36*b* at its proximal end 23*b* a tachometer 37 to indicate the R.P.M. output of shaft 23 and, correspondingly, to insure that the other shafts 16, 22, 24 are being maintained at the proper R.P.M. output for useful speeds in the performance of the individual functions of the tool associated with each such output shaft. Additionally, a drill chuck 38 may be connected to proximal end 22*b* of another of the output shafts, for example output shaft 22, as shown in FIG. 1. Such drill chuck 38 accommodates a variety of different tools useful for any other procedures that may be necessary or desirable in hobby crafting operations.

The frame 12 should preferably be provided with a brace and spacer support structure shown generally at 39. A high intensity lamp 40, operated by a lamp switch 40*a* is preferably provided, such that each operation may be closely visually monitored before moving on to the next step, to prevent thereby unfinished areas in the final product. Each such output shaft 16, 22, 23, 24 is preferably provided with bearings 41 disposed between such shafts and the frame structure 12. Preferably frame 12 is pivotable such that the sanders 25, 26, 27, 28 are disposable facing the user as shown in FIG. 2 for sanding or grinding operations. Frame 12 may then be pivoted about a pivot arm 42 and locked by locking nuts 42*a*, 42*b* at other times for disposing tachometer 37, drill chuck 38, tumbler assembly 25 or a hacksaw assembly (not shown) upwardly to utilize their various functions, as is shown in FIG. 1. High intensity lamp 40 operable by a switch 40*a* may be supplemented with one or more additional high intensity lamps 43 for ease and comfort of vision, such as is shown particularly in FIG. 1.

Frame 12 may be of any size or shape, although a rectangular configuration approximately four inches by fifteen inches by twenty-four inches has been found to be convenient for normal working. In general, pulleys 11, 14, 17, 19, 20, 21 having a width of one-half inch and shafts 16, 22, 23, 24 having a diameter of one-half inch have been found to be sufficiently strong to withstand the work loads encountered in use of the present invention.

The sanders 25, 26, 27, 28 may be of any convenient size; however, the brass drum sanders 25, 26 should be sufficiently small in diameter to permit their being inserted into the opening in the object being worked, such as the truncated neck of a bottle, jug, jar or other container or object. Disc sanders 27, 28 likewise may be of any size, although it has been found to be advantageous in practice for them to be sufficiently large to permit a substantial surface to be worked all at one time, such as in flattening bottoms and tops of the object being worked.

The brass drum preliminary sander 25 is meant to function at a relatively high speed, approximately 516 R.P.M. being optimal. With a speed of 50 R.P.M. higher, damage to the object being worked is inevitable; if substantially slower speeds are used, the grinding process is correspondingly slower. The optimal speed for finishing drum sander 26 has been found to be approximately 395 R.P.M.; likewise, that speed should not be increased more than approximately a few R.P.M. because there will be a total loss of the finishing function. Similarly, a slower speed results in a correspondingly slower process. Rubber disc sander 27 preferably is adjusted to a speed of approximately 330 R.P.M. to 430 R.P.M. by means of monitoring speed control 34 on tachometer 37, and due to the pulley diameters provided the speed of the other sanders is automatically determined. Aluminum disc sander 28 functions best at approximately 200 R.P.M.; a speed of 400 R.P.M. has been found to be disastrous to the product being worked.

The various pulleys provided must have diameters such that, once the shaft bearing the tachometer is adjusted to the proper R.P.M. level for the particular function to be accomplished by the sander borne thereon, the R.P.M.'s of the other shafts will automatically be determined thereby to the R.P.M. level critical to the accomplishment of the function of the individual sander borne by any given shaft. To that purpose, motor pulley 11 and motor belt driven pulley 14 must have diameters in the ratio of 1½:5 and shaft pulleys 17, 19, 20, 21 must have diameters in the ratio of 2:2½:3:4 respectively.

In actual practice the hobby maker would start with a discarded glass container or object which has had certain portions thereof, such as the top removed by a bottle cutter or the power driven hacksaw assembly, which leaves a very rough, sharp and uneven edge. The first step in the utilization of the present invention to transform such glass container into a finished objet d'art, after the neck of the glass container has been removed by a glass cutter or the power hacksaw assembly, is the utilization or rubber disc sander 17 to remove any high points along the edges of the freshly cut glass. Next, rubber disc sander 17 is used to place a 45° bevel on the outer edge of the surface being worked. Brass drum preliminary sander 25 which is preferably one inch in diameter, is then used to put a 45° bevel on the inner edge of the surface being worked. It has been found in practice that a 45° bevel must be maintained on both the outer and inner edges of the lip surface being worked prior to any substantial smoothing or sanding of the top of the lip surface in order to prevent chipping or breaking of such top lip surface. The edge surface involved may then be further smoothed and finished by the finishing brass drum sander 26. Next, rubber disc sander 27 is utilized to grind the top of such lip surface until it is generally flat. Aluminum disc sander 28 serves as a final leveling device to make sure the top surface of such lip is perfectly flat and has no low spots or high spots, which would detract from its attractiveness or usefulness. The next required step is to return to the finishing brass drum sander 26 to round the lip into a perfectly smooth structure. The side surfaces of the glass bottle being worked may then be ground on the aluminum disc sander 28 to give an attractive and elegant frosted appearance. It is of course understood that such procedures would be modified according to the particular characteristics of the material being worked and the artistic effect sought.

The basic and novel characteristics of the present invention and the attending advantages thereof will be readily understood from the foregoing disclosure by those skilled in the art and it will become readily apparent that various changes and modifications may be made in the form, construction and arrangement of such apparatus as set forth hereinabove without departing from the spirit and scope of the invention. Accordingly, the preferred embodiments of the present invention set forth hereinabove are not intended to limit such spirit and scope in any way.

I claim:

1. A multi-purpose craft finishing apparatus comprising:

motor means for driving said apparatus, said motor means bearing thereon motor pulley means;

motor belt means driven by said motor pulley means;

a plurality of shafts having proximal and distal ends, said shafts bearing thereon shaft pulleys, said shaft pulleys having diameters in the ratio of approximately 2:2½:3:4 respectively, one said shaft bearing a motor belt driven pulley means for driving said shaft by said motor belt means, said motor pulley and said motor belt driven pulley means having diameters in the ratio of approximately 1½ to 5;

brass drum preliminary sander means attached to said distal end of and driven by a first said shaft;

finishing brass drum sander means attached to said distal end of and driven by a second said shaft;

rubber disc sander means attached to said distal end of and driven by a third said shaft;

aluminum disc sander means attached to said distal end of and driven by a fourth said shaft;

connecting belt means releasably engaging said shaft pulleys for simultaneous driving said shafts;

idler means for drivably engaging said connecting belt firmly to said shaft pulleys;

tachometer means attached to and driven by one said shaft; and speed control means connected to said motor means for adjustably maintaining, in cooperation with said tachometer means, one said shaft within functioning R.P.M. range, said pulleys being of such diameter that the R.P.M.'s of the other of said shafts will be automatically determined to be within functional R.P.M. ranges.

2. A multi-purpose craft finishing apparatus as claimed in claim 1 wherein:

said speed control means comprises a rheostat electrically connected to said motor means.

3. A multi-purpose craft finishing apparatus as claimed in claim 1 further comprising:

a circular tumbling drum attached to and driven by one said shaft. working

4. A multi-purpose craft finishing apparatus as claimed in claim 1 further comprising:

a drill chuck attached to and driven by one shaft for accommodating power driven tools for additional working functions.

5. A multi-purpose craft finishing apparatus as claimed in claim 1 further comprising:

illumination means for shedding light upon said ends of said shafts.

6. A multi-purpose craft finishing apparatus as claimed in claim 1 further comprising:

power hacksaw assembly means attached to and driven by one said shaft.

* * * * *